US006039657A

United States Patent [19]

Gidney

[11] Patent Number: 6,039,657

[45] Date of Patent: Mar. 21, 2000

[54] SIDE STROKING GOLF PUTTER

[76] Inventor: Bernard C. Gidney, P.O. Box 368, Ct. Pl., S. China, Me. 04358

[21] Appl. No.: 09/007,759

[22] Filed: Jan. 15, 1998

[51] Int. Cl.[7] ..... A63B 69/36; A63B 53/02

[52] U.S. Cl. ..... 473/252; 473/293; 473/313

[58] Field of Search ..... 473/251, 252, 473/313, 314, 340, 255, 256, 293, 409, 131

[56] References Cited

U.S. PATENT DOCUMENTS

| | | |
|---|---|---|
| D. 247,791 | 4/1978 | Monteleone . |
| D. 359,330 | 6/1995 | Channell . |
| D. 375,131 | 10/1996 | Williams . |
| 2,843,384 | 7/1958 | Schmidt . |
| 3,319,962 | 5/1967 | Summers . |
| 3,486,755 | 12/1969 | Hodge . |
| 4,065,133 | 12/1977 | Gordos . |
| 4,163,554 | 8/1979 | Bernhardt . |
| 4,227,694 | 10/1980 | Drake . |
| 4,240,636 | 12/1980 | Swenson . |
| 4,411,429 | 10/1983 | Drew et al. . |
| 4,592,552 | 6/1986 | Garber . |
| 5,127,653 | 7/1992 | Nelson . |
| 5,382,019 | 1/1995 | Sneed . |
| 5,417,429 | 5/1995 | Strand . |
| 5,447,313 | 9/1995 | Finely . |
| 5,454,564 | 10/1995 | Kronogård . |
| 5,597,364 | 1/1997 | Thompson . |

OTHER PUBLICATIONS

"Rules of Golf for 1992," Supplement To Golf Digest And The Rules of Amateur Status, pp86–87, 1992.

*Primary Examiner*—Sebastiano Passaniti
*Attorney, Agent, or Firm*—Lacasse & Associates; Wesley L. Strickland; Randy W. Lacasse

[57] ABSTRACT

A golf putter is gripped with one hand and controlled by the back to forward pendulum motion of one arm, this motion is reminiscent to the natural swing of the arm at the user's side when engaged in walking. A striking face with a loft between 0 and 10 degrees blends down into sole comprised of parallel grooves running from striking face to rear to reduce any resistance with putting surface. The rear of the putter head is nearly twice the width of the striking face completing the compass shape of the putter head, the wider rear portion provides greater weight distribution to the sides and rear of the striking face to prevent any twisting of the putter head on off-center shots. Universally designed connecting shank protrudes up and forward from putter head socket providing clearance between shank and ball as well as aiding in aiming, the shank next angles back towards the putter head at a finishing angle of at least 10 degrees from the vertical plane. A shank socket will accept a straight shaft with a minimum length of 18 inches to an unlimited maximum length terminating in a grip with one flat side aligned with the striking face.

20 Claims, 3 Drawing Sheets

SIDE STROKING GOLF PUTTER

BACKGROUND OF TH INVENTION

1. Field of Invention

The present invention relates generally to golf clubs. More specifically, the present invention is related to an improved croquet-style golf putter.

2. Discussion of Prior Art

Winning is paramount to virtually all avid golfers with most matches decided by a very small margin of victory. Thus, what better way to reduce one's total score than to improve his or her outcome consistently with the only club used on every hole in a round of golf, the putter. Putters are numerous to say the least, but that is a good thing, for all problems that are worked on by so many, the evolution is fast and the end result is great. The problems that still exist today in the prior art are dwindling, and this present invention will virtually eliminate the inadequacies of those putters cited.

Conventional golf putters require a golfer to stand perpendicular to the path a golf ball will travel. Also, golfers are required to twist their neck to alternate looking at a cup and a ball, all while hunched over their putter. Croquet-style putters attempt to alleviate the inherent difficulty of using a conventional putter by allowing a golfer to face in the direction of the putt and use a more natural, pendulum-like swing from a more natural body position. However, the design of previous croquet-style putters have created their own disadvantages.

Summary of disadvantages of prior art croquet-style putters

- The point of shaft attachment to the putter head in most prior art is off center, creating an undesired hand position which is not above the putter head at the time of impact, this hand position can result in the putter head twisting to one side causing an errant shot.
- The shaft attachment to the toe of the putter head resulting in the putter head being too far from the user to keep an accurate travel path during the swing.
- The attachment of the shaft to the rear of the putter head which causes the center of gravity to be displaced from the striking face to a point somewhat behind resulting in less consistency.
- Prior art putters in many instances are not in accordance with U.S.G.A rule 4-1b which states, "the axis of the shaft from the top to a point not more than 5 inches above the sole must diverge from the vertical in the toe-heel plane by at least 10 degrees", thus several prior art putters would be subject to disqualification in U.S.G.A. sanctioned events.
- Most prior art is used in a motion across the front of the user, from one side to the other, in a somewhat unnatural swinging of the arms as one unit.
- A Striking face having a convex curve is found in at least one prior art, to be forgiving on directional inaccuracy; the inventor did not take into account the spin put on the ball by an off center strike with such a design.
- The sliding of some prior art putters over the putting surface would undoubtedly make for many poorly hit putts, as the user would be reliant on the condition of the putting surface.
- Croquet-style putters designed to be used between the legs or to be used with one foot behind the ball limit the backswing of the user.
- Most prior art is designed to be used solely with a two-handed grip in which the user will experience inconsistencies caused by one hand being dominant over the other hand, and the variances created by having the user's wrists involved as part of the swing.
- Prior art in some cases have made the design of the putter reliant upon specialized grips, many of which are impermissible per U.S.G.A rule 4-1c.

Specific discussion of prior art:

The patent to Kronogård (U.S. Pat. No. 5,454,564) discloses a golf putter having a bent shaft wherein the shaft is attached to the putter head eccentrically. This design with the angled shaft results in the putter having a swing line too far out from the user's side. The attachment of the shaft to the toe of the putter head displaces the center of gravity and thus the sweet spot on the striking face. The offset shaft placement also distorts the user's ability to correctly align the putt.

The patent to Drake (U.S. Pat. No. 4,227,694) discloses a golf putter with the shaft extending horizontally in front of the putter head which is used as an aiming device. This horizontal extension requires the second bend in the shaft located approximately midway up the shaft to return the upper shaft to a usable position. The U.S.G.A has a rule Appendix II 4–16, "The shaft shall be straight from the top of the grip to a point not more than 5 inches (127 mm) above the sole." This rule would prohibit this putter from being used in U.S.G.A sanctioned matches, because of the second bend. This putter also requires a two handed grip even though it is front facing putter, with the user standing behind the ball.

The patent to Garber (U.S. Pat. No. 4,592,552) discloses a three-sided putter of which two of the sides are striking faces. Both faces are perpendicular to one another as well as being perpendicular to the top of the putter head. This is in contrast to rule 4-d of U.S.G.A which states, " . . . faces must be opposite one another . . . " The hosel attaches to the rear or third side of the putter and causes the shaft to extend generally straight upward. This feature alone is in contrast to the U.S.G.A rule which states, "The shaft must diverge from the vertical toe to heel plane by at least ten degrees." The perpendicular striking faces at the time of impact will cause the ball to skid somewhat before the ball begins its rotation, thus creating another variable to be overcome. The following list often patents have at least one, and in many cases more than one, of the above-detailed disadvantages:

- U.S. Pat. No. 5,382,019 issued to Wilbert Sneed on Jan. 17, 1995;
- U.S. Pat. No. 2,843,384 issued to Theodore Schmidt on Jul. 15, 1958;
- U.S. Pat. No. 4,163,554 issued to Floyd Berhardt on Aug. 7, 1979;
- U.S. Pat. No. 4,065,133 issued to Ambrose Gordos on Dec. 27, 1977;
- U.S. Pat. No. 4,411,429 issued to John Drew et al. on Oct. 25, 1983;
- U.S. Design Pat. No. 375,131 issued to Daniel Williams on Oct. 29, 1996;
- U.S. Pat. No. 3,486,755 issued to William Hodge on Dec. 30, 1969;
- U.S. Pat. No. 5,447,313 issued to Richard Finley on Sep. 5, 1995;
- U.S. Pat. No. 3,319,962 issued to Roger Summers on May 16, 1967; and
- U.S. Pat. No. 4,240,636 issued to Ronald Swenson on Dec. 23, 1980.

SUMMARY OF THE INVENTION

Whatever the precise merits, features and advantages of the above cited references, none of them achieve or fulfill the purposes of the present invention. Accordingly it is an object of the present invention to provide for an improved putter shaft configuration with attachment to the putter head positioned centrally in a side to side plane so that the user's hand will be above the putter head at the time of impact. This hand position will provide for a better center of gravity and truer shot.

It is another object of the present invention to provide an improved putter with a centrally located shaft to allow the user to keep his or her arm at their side during the alignment and swing resulting in a more natural arm position and consistent results.

It is an additional object of the present invention to provide an improved putter which complies generally with all current U.S.G.A. rules so as to be usable in U.S.G.A.-type events.

It is an additional object of the present invention to provide an improved putter with a specially designed connecting shank which can be used with most any putter head and shaft on the market, and still provide ample ball clearance and the correct shaft angle of at least ten degrees for U.S.G.A. compliance.

It is an additional object of the present invention to provide for an improved putter gripped and controlled by only one hand at the side of the user.

It is an additional object of the present invention to provide an improved putter with a flat striking face with a loft from 0 to 10 degrees to create a slight backspin at impact for a smooth controlled speed even on declines in the putting surface.

It is an additional object of the present invention to provide for an improved putter which will be consistently above the putting surface throughout the swing.

It is an additional object of the present invention to provide an improved putter to be used in an arc-like motion at the user's side, first moving the arm in a perpendicular motion to the rear then in a reverse motion to the front resulting in a smooth symmetrical swing.

It is an additional object of the present invention to provide for an improved putter which is held in one hand, with the back of the hand facing forward towards the target and maintaining slight pressure on the tip of the extended index finger to keep the upper part of the grip firmly against the back of the forearm, this stifles any wrist movement in the swing, thus a more consistent accurate swing.

It is an additional object of the present invention to provide an improved putter that the user may lean his or her head slightly to the side, giving them a direct line over the putter head to the intended target, the user may then sight to the target with only eye movement (no head movement is required as with conventional putters).

It is an additional object of the present invention to provide for an improved putter that the user may align the upper portion of the shank between the two aiming lines to create a very accurate sighting device.

It is an additional object of the present invention to provide for an improved putter with a shape like that of a mathematical compass, with the striking face at the smallest width of the putter head and the rear of the head wider to keep weight well dispersed to the sides of the point of impact, thus reducing any twisting motion on off-center hits.

It is an additional object of the present invention to provide for an improved putter with grooves on the sole to reduce any resistance that may be caused when putting from the fringe.

It is an additional object of the present invention to provide for an improved putter that allows older users and users with back problems to stand erect while putting.

It is a further object of the present invention to provide an improved putter suitable in design for persons with the handicap of having only one arm.

Further objects and advantages are to provide an improved putter to be held with one hand to increase consistency in putting regardless if the user is novice, intermediate or professional.

These and other objects are achieved by the detailed description that follows.

DESCRIPTION OF THE PREFERRED EMBODIMENTS

Figure 1:
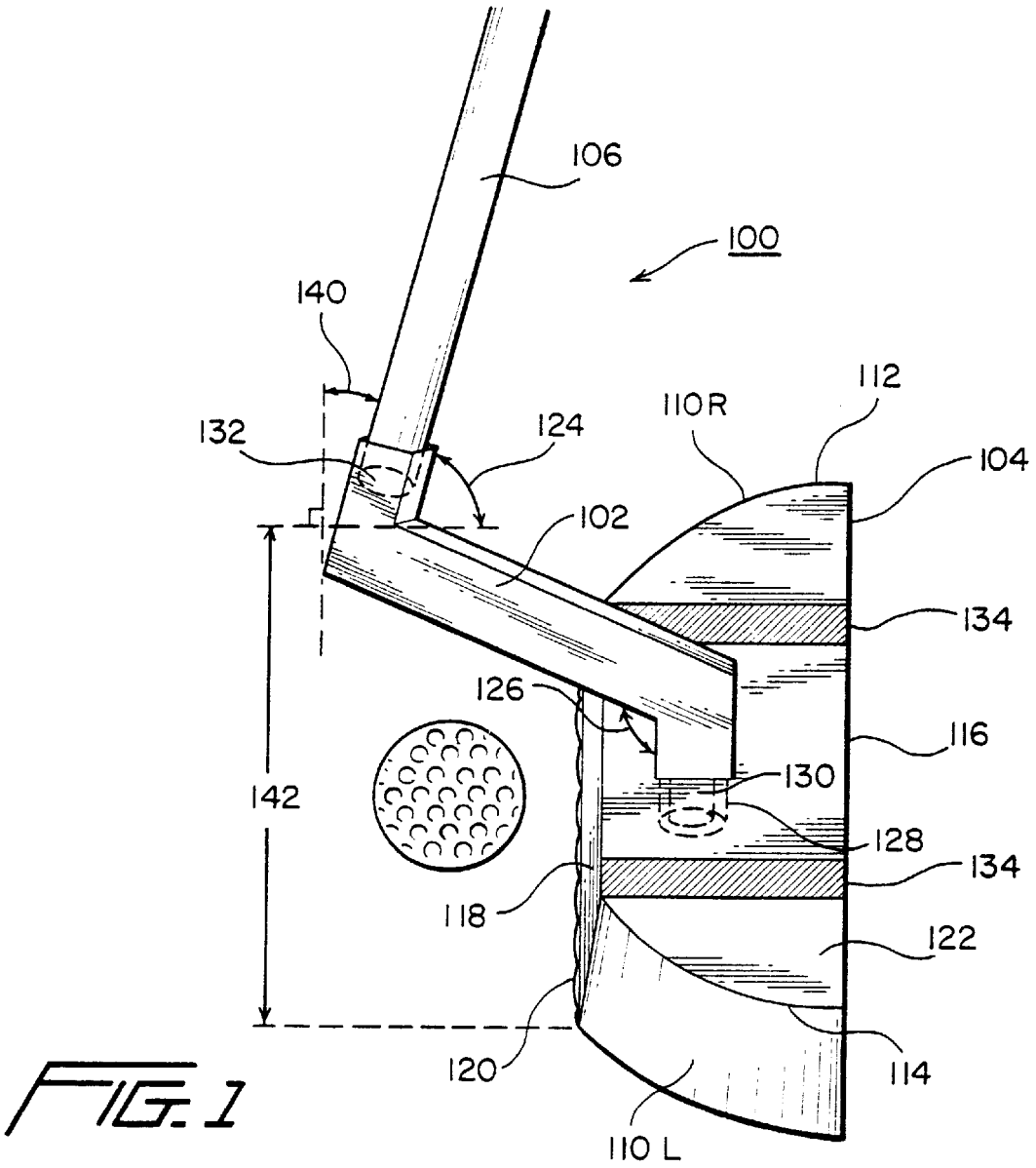
FIG. 1 illustrates a composite of a putter head, connecting shank and shaft.

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications of the materials for its construction and is not intended to limit the invention to the embodiment illustrated. Those skilled in the art will envision many other possible variations falling within the scope of the present invention.

The preferred embodiment of the present invention is illustrated in FIG. 1. A golf putter 100 generally comprising a putter head 104, connecting shank 102, and shaft 106. The following descriptions are based on a user who is right-handed, it will be understood that putter 100 performs equivalently for a left-handed user with no alterations or adjustments needed. Putter head 104 includes flat striking face 118 having a loft of 0–10 degrees. The width of striking face 118 is greater than the measurement from striking face 118 to rear face 116. The compass shape of putter head 104 maintains the trueness of the swing through weight dispersement to rear face 116 and curved sides 110R and 110L. Hitting a ball off-center on striking face 118 will not significantly affect either the line of the putting stroke or the ball's expected travel path. Top surface 122 includes socket 128 machined into it to accept male adapter 130 at the end of connecting shank 102. Socket 128 is located at any point upon a perpendicular line from the top center of striking face 118 to the top center of rear face 116. Connecting shank 102 is affixed to putter head 104 so that angle 176 positions shank 102 out in front of putter head 104. Angle 124 reverses the direction of the shank 102 back towards and above putter head 104. The end of shaft 106 is then affixed into shank opening 132 to extend shaft 106 to a comfortable length for the user. The result of both angles 124 and 126 is to have shaft 106 diverge from the vertical in the toe 112 to heel 114 plane by at least, and not limited to, 10 degrees 140 while allowing the user's hands to be above putter head 104. To further comply with U.S.G.A regulations, the horizontal plane of angle 124 is not more than 5 inches above 142 putter head sole 120.

Figure 2:
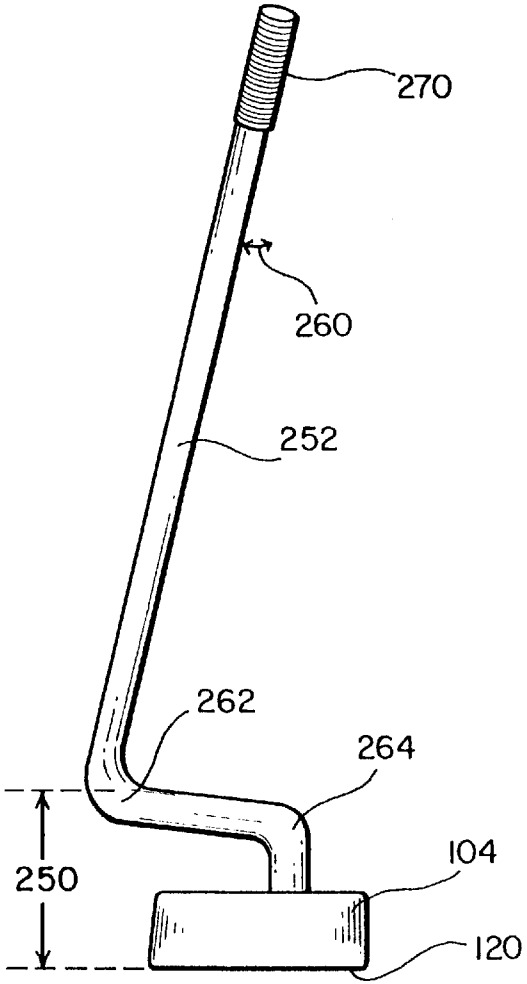
FIG. 2 illustrates an alternate embodiment of the present invention having a single-piece bent shaft.

Similar results can be achieved in an alternate single-shaft embodiment illustrated in FIG. 2. Bent shaft 252 is affixed to putter head 104 so that angle 264 positions shaft 252 out in front of putter head 104 to a point where angle 262 reverses the direction of shaft 252 back towards and above putter head 104. The angles 262 and 252 correspond to the angles of FIG. 1, 124 and 126 respectively.

Figure 3:
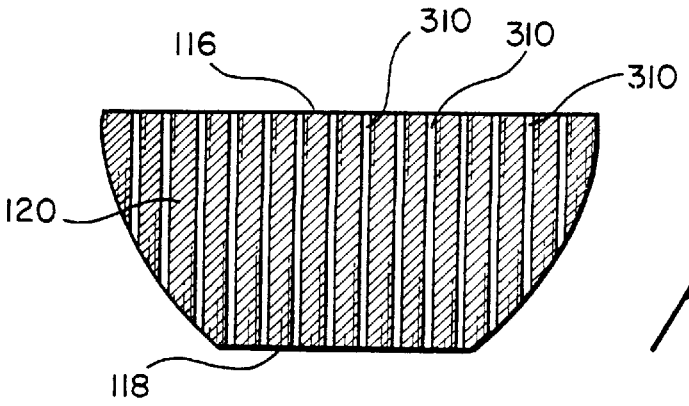
FIG. 3 illustrates a bottom view of the putter head of the present invention.

Grooves 310, as shown in FIG. 3, are incorporated into sole 120 of putter head 104 as a means to lessen resistance between putter head 104 and a putting surface. Grooves 310 are tapered upwardly at both ends, and each groove 310 runs perpendicular from rear face 116 to striking face 118. When putting from the fringe, the grooves will allow an uneven surface to be traversed with reduced resistance and twisting.

Figure 4B:
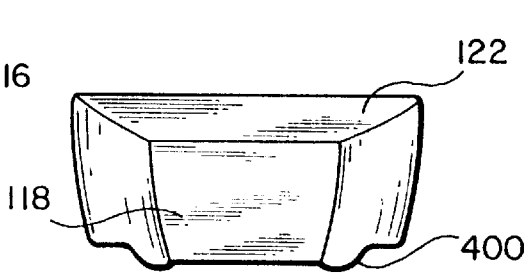
FIGS. 4*a* and 4*b* in combination illustrate an alternate embodiment of the invention wherein a putter head sole is wave shaped with two large lobes.
Figure 4A:
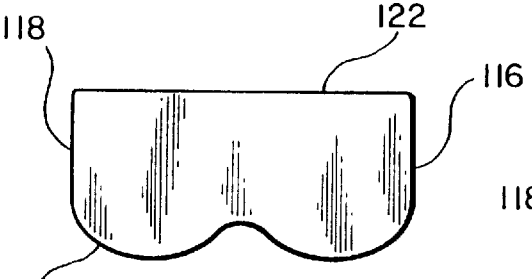
Figure 4D:
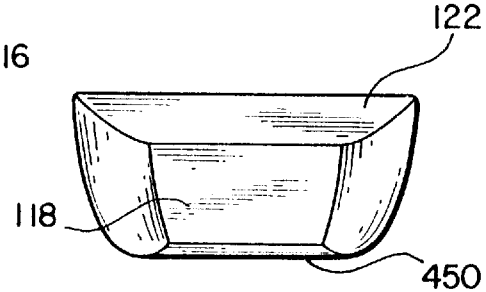
FIGS. 4*c* and 4*d* in combination illustrate an alternate embodiment of the invention wherein a putter head sole is bowl shaped.
Figure 4C:
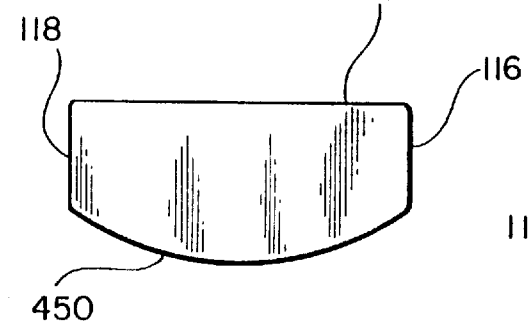

Other embodiments of the sole 120 that also lessen resistance between putter head 104 and a putting surface include: a wave shaped sole 400 as illustrated in FIGS. 4*a* and 4*b*, and a bowl shaped sole 450 as illustrated in FIGS. 4*c* and 4*d*. Wave shaped sole 400 has a first lobe which smoothly transitions from front face 118, rises up into a shallow trough near the center of the putter head sole and then continues rearwardly into a second lobe which smoothly transitions into rear face 116.

Figure 5B:
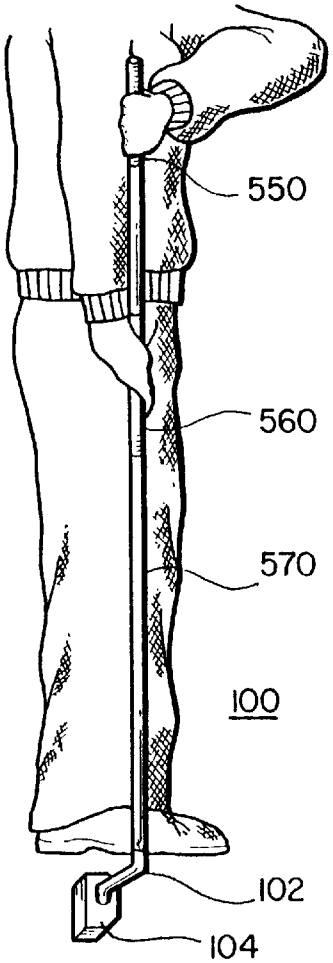
FIGS. 5*a* and 5*b* in combination illustrate the stance and use of a golfer using the present invention.
Figure 5A:
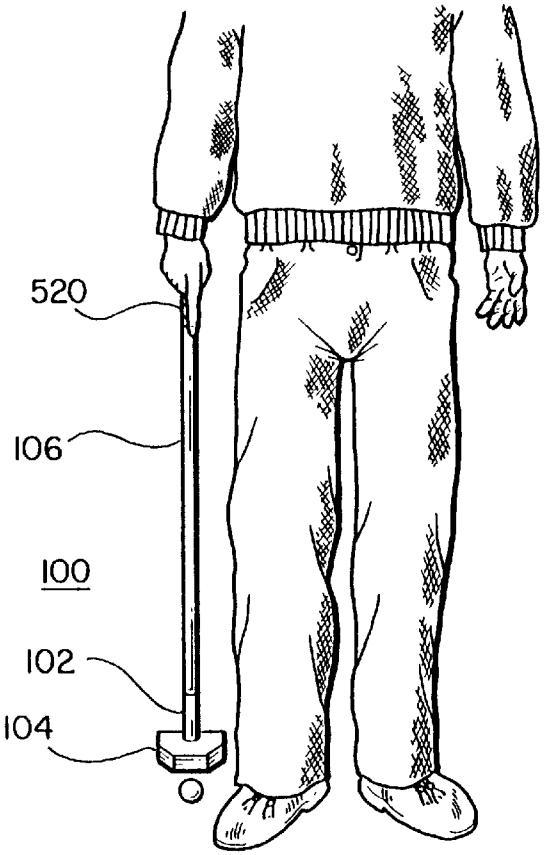

FIGS. 5*a* and 5*b*, collectively, illustrate the manner for using the side stroking golf putter. The user addresses the ball with his or her body facing directly toward the hole, with the ball at the side of the foot (near the right foot for a right-handed putt, or near the left foot for a left-handed putt), see FIG. 5*a*. At this point, a proper grip is with the index finger placed straight down the front of the grip 520 and the same finger placed on the side of the grip 520, closest to the user. The top of the hand is faced directly at the intended travel path of the ball, with the remaining fingers comfortably wrapping around the grip 520. The user's feet are adjusted accordingly for a stable stance. Putter head 104 is now aimed at the intended travel path with the aid of aiming devices 134, visible markings or indications, and/or the visible part of shank 102. Pressure is applied at the tip of index finger to keep the upper portion of grip 520 against the back of user's forearm. Arm and putter 100 (now being an extension of that arm) are now slowly moved back from the ball on the same imaginary line of intended path. The weight of the putter 100 combined with the weight of the lower arm, now only require minimal effort from the upper arm to swing the putter 100 in a smooth arcing motion down and through the point of impact with the ball.

Grip 520 is located at the top of shaft 106. Shaft 106 is a minimum of 18 inches to a maximum with no limits other than user preference. A second grip 560 may be added to putter 100 if the length of shaft 570 is excessive and putter 100 is used as in FIG. 5*b*, typical of a senior player length.

Figure 6:
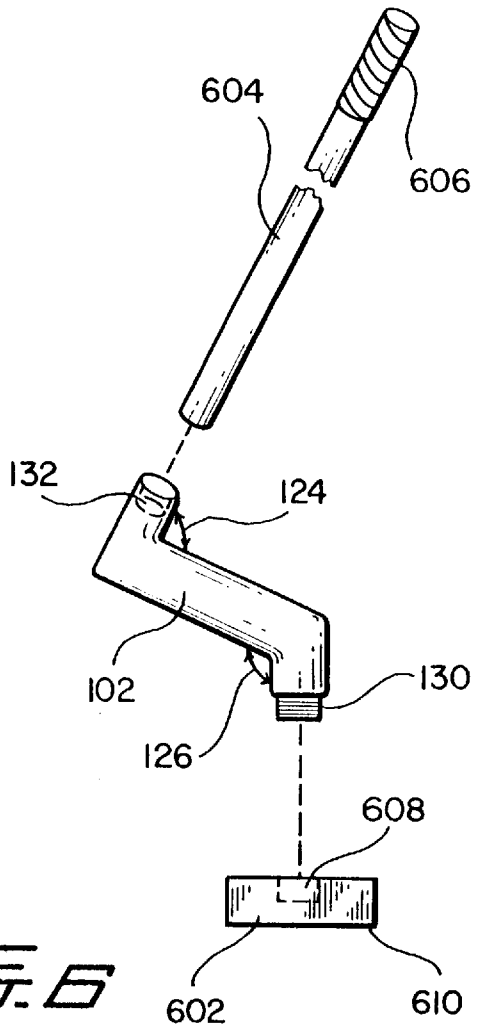
FIG. 6 illustrates an alternate embodiment of the invention wherein angled connector (102 of FIG. 1) adapts a conventional putter head and shaft to a croquet-style putter.

An alternate embodiment of this invention is illustrated in FIG. 6. The present invention can be used to modify an existing putter. An existing putter is disassembled into its various components; putter head 602, shaft 604 and grip 606. Connecting shank 102 enables use of an existing putter of virtually any size or shaped head 602, shaft 604 and grips 606 available. Shank 102 is specifically designed to give the exact angles 124, 126 when secured to a top surface of existing putter head 602 with a planer top parallel to the putting surface. Connecting shank 102 is affixed to a hosel (not shown), if present, or directly to putter head 602 at receiving socket 608 so that angle 126 positions shank 102 out in front of putter head 602. Angle 124 reverses the direction of the shank 102 back towards and above putter head 602. The end of shaft 604 is then varied in length according to the user's requirements and affixed into shank opening 132 to extend shaft 604 to a comfortable length for the user.

The result of both angles 124 and 126 is to have shaft 604 diverge from the vertical by at least, and not limited to, 10 degrees while allowing the user's hands to be above putter head 602. To further comply with U.S.G.A regulations, the horizontal plane of angle 124 is not more than 5 inches above putter head sole 610.

Accordingly, the present invention in its various embodiments make the game of golf more enjoyable to a wide variety of players by not only producing more accurate results, but also by realizing some special needs. The golfer who has trouble bending down because of age or back problems will now be able to stand erect to putt the golf ball. The golfer who may have only one arm can now use the present invention to improve his or her game. The present invention is designed to remove many of the variables to putting, a part of the game of golf that is very precise and costly score wise to many golfers. The smooth motion of the putt controlled by a single arm is a major improvement in speed and accuracy over the putt with the putter held by two hands, attempting to be as one. Replacing the side-to-side movement of the user's head with the simple up and down movement of the user's eyes is a great improvement. Other improvements include:

- enabling the swing of the club to be controlled by the larger arm muscles instead of the two handed putt which is too often inconsistent because of variations in wrist position at the time of impact with the ball;
- the shank which ultimately allows the user's hand to be above the putter head giving a better feel, as well as larger sweet spot during impact, and
- the universal socket on the shank allowing the user to personalize his or her putter by accepting any straight shaft with a tip dimension of 370 mm and therefore virtually any putter grip as well.

Although the description above contains many specifics, these should not be construed as limiting the scope of the invention, but as merely providing illustrations of some of the presently preferred embodiments of this invention. For example, the putter shaft may vary in length from a mere 18 inches to a shaft that is shoulder height and anything in between.

The shaft may have only one grip at the top of the shaft or another grip located below the first. Thus, the scope of the invention should be determined by the appended claims and their legal equivalents, rather than by the examples given.

CONCLUSION

A system and method has been shown in the above embodiments for the effective implementation of a side stroking golf putter. While various preferred embodiments have been shown and described, it will be understood that there is no intent to limit the invention by such disclosure, but rather it is intended to cover all modifications and alternate constructions falling within the spirit and scope of the invention as defined in the appended claims. For example, the present invention should not be limited by size, specific shape, materials, textures, colors, etc.

I claim:

1. A croquet-styled golf putter, said croquet-styled putter to be used in a forward facing address position and comprising:

a putter head comprising at least a top surface, a bottom surface, a front face, a rear face;

a double-angled connecting section having a first upper end with a central axis forward of the front face by a distance generally greater than the diameter of a USGA regulation golf ball addressed by said putter head and substantially central to said front face, an angled section overhanging said front face, a second lower end attached on a substantially central axis to said top surface of said putter head;

a one-handed shaft comprising a grip located substantially within a plane containing said putter head front face, said shaft connected to said first upper end of said double-angle connecting section, and wherein said first upper end and angled section of said double-angle connecting section intersect no greater than 5 inches vertically from said putter head bottom surface.

2. A croquet-styled golf putter, as per claim 1, wherein the longitudinal axis of said shaft diverges from vertical by at least 10 degrees.

3. A croquet-styled golf putter, as per claim 1, wherein said putter head comprises a front vertical ball-striking face, a rear vertical face, horizontal top and bottom surfaces, and arc-shaped toe and heel.

4. A croquet-styled golf putter, as per claim 1, wherein a length of said rear face exceeds a length of said front face.

5. A croquet-styled golf putter, as per claim 1, wherein said putter head top surface further comprises aiming-assistance markings on each side of where said double-angle section second lower end attaches to said putter head top surface.

6. A croquet-styled golf putter, as per claim 1, wherein said putter head bottom surface further comprises any one of the following: a plurality of alternating ridges and channels which are aligned perpendicular to said front and rear faces and extend across said bottom surface; a bowl shaped surface which tapers up into said front and rear faces; a wave shaped surface with two lobes and a trough which are aligned parallel with said front and rear faces.

7. A croquet-styled golf putter, as per claim 1, wherein said double-angle connecting section second lower end attaches to said putter head top surface at any point on a perpendicular line drawn from said putter head front face's center to said rear face's center.

8. A croquet-styled golf putter, as per claim 1, wherein said putter head front face is angled between 0 and 10 degrees, inclusive, from vertical.

9. A croquet-styled golf putter, as per claim 1, wherein said shaft and double-angle connecting section are integrally formed as a single section.

10. A method of converting an existing conventional golf putter to a croquet-styled putter, said croquet-styled putter to be used in a forward facing address position and comprising:

disassembling said existing golf putter into at least a shaft, with grip, and putter head, said putter head comprising at least a top and bottom surface;

connecting a double-angle connecting section having a first upper end with a central axis forward of the front face by a distance generally greater than the diameter of a USGA regulation golf ball addressed by said putter head and substantially central to said front face, an angled section overhanging said front face, a substantially axially-central second lower end to said top surface of said putter head;

connecting said shaft to said first upper end of said double-angle connecting section, said shaft comprising a grip located substantially within a plane containing said putter head front face, and wherein said first upper end and angled section of said double-angle connecting section intersect no greater than 5 inches vertically from said putter head bottom surface.

11. A method of modifying an existing conventional golf putter, as per claim 10, wherein the longitudinal axis of said shaft diverges from vertical by at least 10 degrees.

12. A method of modifying an existing conventional golf putter, as per claim 10, wherein said grip is centrally located above said putter head.

13. A croquet-styled golf putter, said croquet-styled putter to be used in a forward facing address position and comprising:

a putter head comprising at least a top surface, a bottom surface, a front face, a rear face;

a double-angle connecting section having a first upper end with a central axis forward of the front face by a distance generally greater than the diameter of a USGA regulation golf ball addressed by said putter head and substantially central to said front face, an angled section overhanging said front face, a second lower end attached on a substantially central axis to said top surface of said putter head;

a one-handed shaft comprising a grip located substantially within a plane containing said putter head front face, said shaft section having a first upper end, a substantially straight section, a second lower end connected to said first upper end of said double-angle connecting section, and wherein said first upper end of said shaft is centrally located above said putter head.

14. A croquet-styled golf putter, as per claim 13, wherein the longitudinal axis of said shaft diverges from vertical by at least 10 degrees.

15. A croquet-styled golf putter, as per claim 13, wherein said first upper end and angled section of said double-angle connecting section intersect no greater than 5 inches vertically from said putter head bottom surface.

16. A croquet-styled golf putter, as per claim 13, wherein said putter head top surface further comprises aiming-assistance markings on each side of where said double-angle section second lower end attaches to said putter head top surface.

17. A croquet-styled golf putter, as per claim 13, wherein said putter head bottom surface further comprises any one of the following: a plurality of alternating ridges and channels which are aligned perpendicular to said front and rear faces and extend across said bottom surface; a bowl shaped surface which tapers up into said front and rear faces; a wave shaped surface with two lobes and a trough which are aligned parallel with said front and rear faces.

18. A croquet-styled golf putter, as per claim 13, wherein said double-angle connecting section second lower end attaches to said putter head top surface at any point on a perpendicular line drawn from said putter head front face's center to said rear face's center.

19. A croquet-styled golf putter, as per claim 13, wherein said putter head front face is angled between 0 and 10 degrees, inclusive, from vertical.

20. A croquet-styled golf putter, as per claim 13, wherein said shaft and double-angle connecting section are integrally formed as a single section.

* * * * *

UNITED STATES PATENT AND TRADEMARK OFFICE

CERTIFICATE OF CORRECTION

PATENT NO. : 6,039,657

DATED : March 21, 2000

INVENTOR(S) : Bernard C. Gidney

It is certified that error appears in the above-identified patent and that said Letters Patent is hereby corrected as shown below:

IN THE SPECIFICATION

Column 2, line 43, delete "often" and insert --of ten--.

Column 5, line 2, delete "176" and insert --126--.

Signed and Sealed this

Eighth Day of May, 2001

*Attest:*

Nicholas P. Godici

NICHOLAS P. GODICI

*Attesting Officer*

*Acting Director of the United States Patent and Trademark Office*